US006842973B2

(12) United States Patent
Share et al.

(10) Patent No.: US 6,842,973 B2
(45) Date of Patent: Jan. 18, 2005

(54) APPARATUS FOR ATTACHING SLIDERS ONTO ZIPPER BAGS AND FILM

(75) Inventors: Lawrence Share, Skokie, IL (US); Michael Pollack, Vernon Hills, IL (US); Stanley Piotrowski, Schiller Park, IL (US); Michael McMahon, Palatine, IL (US)

(73) Assignee: Illinois Tool Works Inc., Glenview, IL (US)

( * ) Notice: Subject to any disclaimer, the term of this patent is extended or adjusted under 35 U.S.C. 154(b) by 160 days.

(21) Appl. No.: 10/112,808

(22) Filed: Mar. 29, 2002

(65) Prior Publication Data

US 2003/0183314 A1 Oct. 2, 2003

Related U.S. Application Data

(63) Continuation-in-part of application No. 10/096,409, filed on Mar. 11, 2002.

(51) Int. Cl.[7] ..... A41H 37/06

(52) U.S. Cl. ..... 29/768; 29/33.2; 29/766; 156/552

(58) Field of Search ..... 156/66, 499, 538, 156/552; 493/214, 383; 29/33.2, 768, 766, 32.2

(56) References Cited

U.S. PATENT DOCUMENTS

| | | | | |
|---|---|---|---|---|
| 5,152,613 A | * 10/1992 | Herrington, Jr. | ..... | 383/63 |
| 5,383,989 A | 1/1995 | McMahon | ..... | 156/66 |
| 6,161,271 A | * 12/2000 | Schreiter | ..... | 29/408 |
| 6,178,722 B1 | * 1/2001 | McMahon | ..... | 53/412 |
| 6,286,189 B1 | * 9/2001 | Provan et al. | ..... | 24/30.5 R |
| 6,675,558 B2 | * 1/2004 | Kinigakis et al. | ..... | 53/412 |

FOREIGN PATENT DOCUMENTS

| | | |
|---|---|---|
| EP | 0 516 393 A1 | 12/1992 |
| GB | 2085519 A | 4/1982 |

* cited by examiner

*Primary Examiner*—Gladys J P Corcoran
(74) *Attorney, Agent, or Firm*—Pitney Hardin LLP

(57) ABSTRACT

A keeper (12), a clamp (14), a heater strip (16) and a heated air diffuser (18) are provided for a slider insertion apparatus (10) which inserts sliders (28) on the interlocked profiles (20, 22) of a zipper (23). The heater strip (16) and/or the diffuser (18) heat the zipper (23) to a predetermined temperature prior to slider insertion. The keeper (12) aligns the slider (32) within the insertion area (34) with the activator with pusher (26) of the slider insertion apparatus (10). By changing the mounting of the zipper guide (28) and by actuating the clamp (14) during slider insertion, the zipper (32) indexes to the slider insertion apparatus (10) in alternate directions.

8 Claims, 6 Drawing Sheets

APPARATUS FOR ATTACHING SLIDERS ONTO ZIPPER BAGS AND FILM

RELATED APPLICATION

This application is a continuation-in-part of application Ser. No. 10/096,409, filed Mar. 11, 2002, entitled "INSERTION APPARATUS FOR ATTACHING SLIDERS ONTO ZIPPER BAGS AND FILM".

FIELD OF THE INVENTION

The present invention relates to the process of inserting sliders onto slide zippers used on reclosable plastic bags and, more particularly, to components of a slider insertion apparatus in which the components retain the slider within the slider insertion area of the apparatus, preheat the zipper before slider insertion, and allow the zipper to index in an alternate direction for slider insertion.

DESCRIPTION OF THE PRIOR ART

Reclosable bags having slide zippers are generally more desirable to consumers than bags which have traditional interlocking zippers, since such bags are perceived to be easier to open and close than slider-less zippers. As a result, slide zippers for use with plastic bags are numerous and well-known in the reclosable fastener art. Typical slide zippers comprise a plastic zipper having two interlocking profiles and a slider for engaging and disengaging the interlocking profiles of the zipper.

Methods and apparatuses for manufacturing reclosable plastic bags using reclosable zippers with a slider are also well-known in the art. Known slider loaders include the Hugues reference (U.K. Patent No. 2,085,519) and the LaGuerve reference (U.S. Pat. Nos. 3,701,191 and 3,701,192) as well as the slider insertion apparatus provided in application Ser. No. 10/096.409 filed Mar. 11, 2002; entitled "INSERTION APPARATUS FOR ATTACHING SLIDERS ONTO ZIPPER BAGS AND FILM".

As such, the indexing of zippers to a slider loader and the insertion of a slider in a particular area of the slider loader are fairly well-developed in the prior art, but nevertheless remain open to improvements contributing to increased efficiency and cost-effectiveness during the manufacture of reclosable bags.

A first improvement is the addition of heat to a zipper length prior to slider insertion. By heating the zipper to a predetermined temperature the interlocked profiles of the zipper are softened, with the result of less force required to offset the profiles or to open the zipper. In the slider insertion apparatus of application Ser. No. 10/096,409 filed Mar. 11, 2002; entitled "INSERTION APPARATUS FOR ATTACHING SLIDERS ONTO ZIPPER BAGS AND FILM", the softening provided by heating allows the profiles to offset each other more easily, thereby providing an easier slider insertion. For other slider loaders in the art, the softening provided by heating reduces the external opening force required to separate the profiles for slider insertion. This is especially important since the external opening force of the zipper increases at colder temperatures. If the external opening force is too high, the zipper is less flexible for slider insertion. As such, decreasing temperatures may result in erratic slider insertion. By adding localized heat to the zipper before slider insertion, the possibility of erratic slider insertion decreases. This can be important if the slider loader or the slider insertion apparatus is located in a setting where maintaining a suitable ambient temperature is difficult.

A further improvement is to provide a keeper in the insertion area of the slider insertion apparatus. A keeper, pressing against a slider to be inserted, allows the slider to be retained and aligned in the insertion area regardless of the mounting position of the slider insertion apparatus or the bouncing/vibration in the apparatus. As such, the amount of jamming in the slider insertion area is reduced and the positioning of the slider prior to insertion is maintained. A reduction in jamming and a proper slider insertion thereby reduces the downtime of the slider insertion apparatus or loader as well as the maintenance problems associated with the downtime.

A still further improvement is to allow the indexing of zippers to a slider insertion area from one direction (such as from right to left) to an opposing direction (such as from left to right). By alternating directions of zipper indexing, the ability to change the overall arrangement of the bag-making machine is enhanced. This ability would be important if the machine or the machine's operating environment is subject to modifications.

SUMMARY OF THE INVENTION

Accordingly, the present invention provides components of a slider insertion apparatus which align the slider within the slider insertion area of the apparatus, preheat the zipper before slider insertion, and allow the zipper to index in an alternate direction for slider insertion.

In the slider insertion process, an interlocked zipper is indexed to a slider insertion apparatus. As the zipper proceeds to the apparatus, an electrically connected heater strip and/or a diffuser heat the zipper. The heater strip heats a longitudinal portion of the zipper while jets of, the diffuser direct heated air at the zipper. By heating the zipper to a predetermined temperature the profiles of the zipper are softened, with the result of less force required to offset the interlocking members of the profiles and less force required to open the zipper. From the heater strip and/or the heated air diffuser, the zipper is fed to the slider insertion apparatus.

While the zipper is being indexed to the apparatus, a keeper retains a slider within an insertion area of the apparatus. The keeper extends through an opening in the insertion area and presses against the slider to align the slider with the pusher that inserts the slider onto the zipper. The keeper, along with a guiding slot on an interior wall of the insertion area, assists the straight guiding of the slider from the loading rack into the insertion area without rotation or misalignment.

If the operating environment of the slider insertion apparatus requires modification, the insertion apparatus can be adjusted to allow indexing of the zipper in an alternate direction. The apparatus is modified by detaching the attachment piece of the zipper guide from a mounting area on one side of the insertion area and re-attaching the attachment piece to another mounting area on an opposite side of the insertion area. During the insertion of the slider, a clamp is actuated to a closed condition on the interlocking profiles to prevent one portion of the zipper from disengaging as the slider is being inserted on another portion of the zipper.

BRIEF DESCRIPTION OF THE DRAWINGS

Thus by the present invention its objects and advantages will become readily apparent upon reading the following detailed description taken in conjunction with the accompanying drawings, in which.

DETAILED DESCRIPTION OF THE PREFERRED EMBODIMENTS

Figure 1:
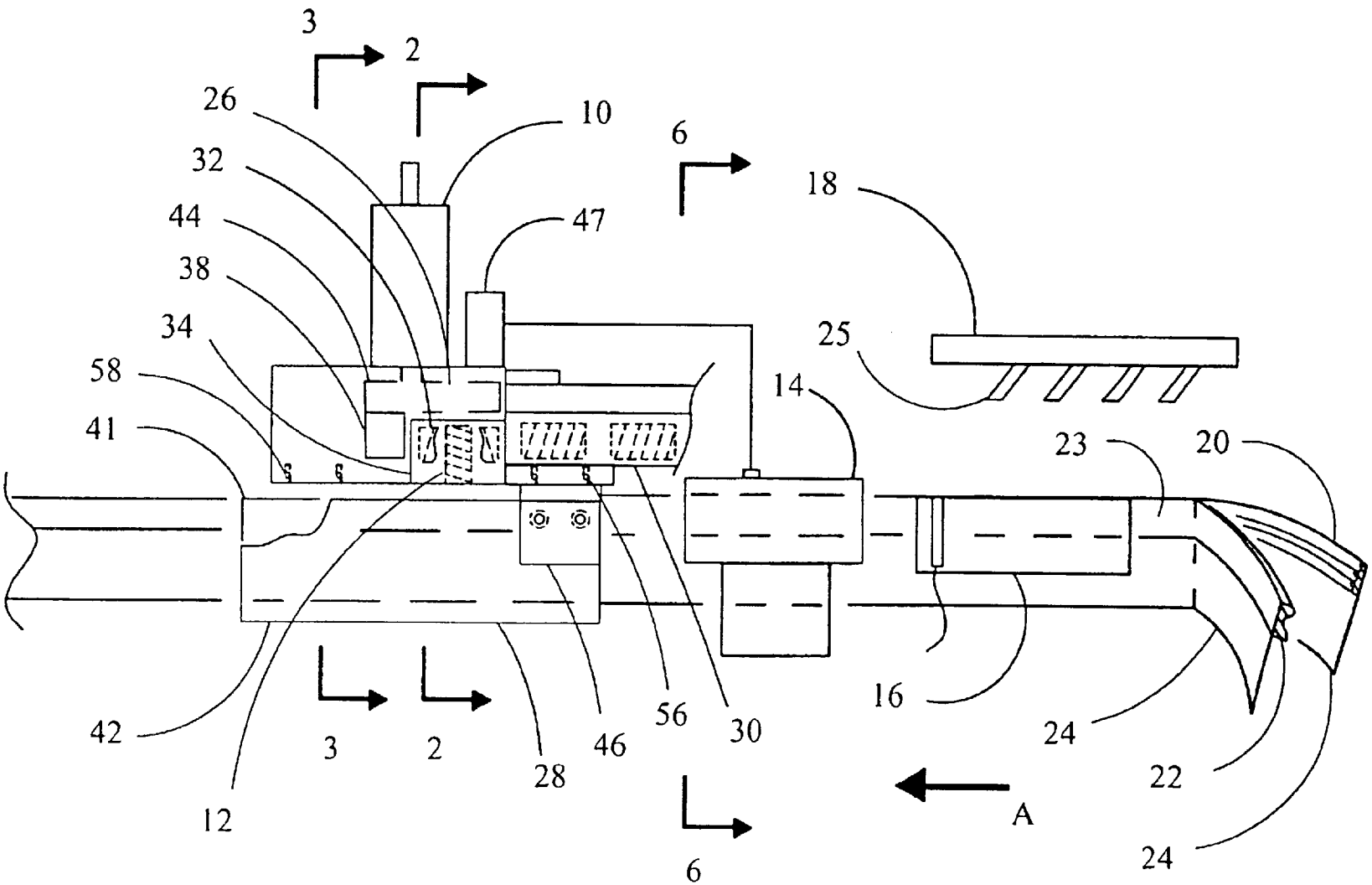
FIG. 1 is a side view depicting the components of the present invention arranged with a slider insertion apparatus with the zipper being indexed in a first direction.

Referring now to the drawings in detail wherein like numerals indicate like elements throughout the several views, FIG. 1 is a side view of the components of the present invention arranged with a slider insertion apparatus 10. As shown in the figure, the components include a keeper 12, a clamp 14, a heater strip 16 and a heated air diffuser 18. The clamp 14 will be further discussed in relation to the detailed figures below.

In the slider insertion process, a male profile 20 and a female profile 22 of a zipper 23 are indexed in direction "A" to the slider insertion apparatus 10. The profiles 20, 22 are interlocked as they are fed to the slider insertion apparatus 10. In the figure, the profiles 20, 22 are detached from each other in one portion of the zipper 23 to illustrate their position on the thermoplastic film 24 used to make a reclosable bag.

As the zipper 23 proceeds to the slider insertion apparatus 10, the electrically connected heater strip 16 and/or the diffuser 18 heat the zipper 23 to a predetermined temperature. The heater strip 16 heats a longitudinal portion of the zipper 23 while jets 25 of the diffuser 18 direct heated air at the zipper. Other heating elements known to those skilled in the art may be used in lieu of the heater strip 16 or the diffuser 18.

By heating the zipper 23 to a predetermined temperature, the profiles 20, 22 are softened with the result of less force required to open the zipper 23. In the slider insertion apparatus 10 shown, the softening provided by heating allows the profiles to offset each other more easily during slider insertion. The offsetting of the profiles 20, 22 in the slider insertion apparatus 10 will, be further discussed below.

For other slider loaders in the art, the softening provided by heating reduces the external opening force required to separate the profiles for slider insertion. This is especially important since the external opening force of the zipper increases at colder temperatures. If the external opening force is too high, the zipper is less flexible for slider insertion. As such, decreasing temperatures may result in erratic slider insertion. By adding a localized heat source such as that provided by the heater strip 16 and/or the heated air diffuser 18, the possibility of erratic slider insertion decreases.

From the heater strip 16 and/or the heated air diffuser 18, the zipper 23 is fed to the slider insertion apparatus 10. The slider insertion apparatus 10 generally includes the keeper 12, an activator with pusher 26 and a zipper guide 28. A loading rack 30 may be part of the slider insertion apparatus 10 or may be mechanically attached to the slider insertion apparatus.

While the zipper 23 is being indexed to the slider insertion apparatus 10, the keeper 12 retains a slider 32 within an insertion area 34 of the apparatus. The keeper 12, shown in FIG. 2 as a leaf spring, is mechanically attached to the exterior of the slider insertion apparatus 10. The keeper extends through an opening in the insertion area 34 and presses against the slider 32 to align the slider with the activator with pusher 26. As such, the keeper 12 holds the aligned slider 32 in the insertion area 34 regardless of the mounting position of the slider insertion apparatus 10 or bouncing/vibration in the slider insertion apparatus. The keeper 12, along with a guiding slot 36, also assists the guiding of the slider 32 from the loading rack 30 into the insertion area 34 without rotation or misalignment.

Figure 3:
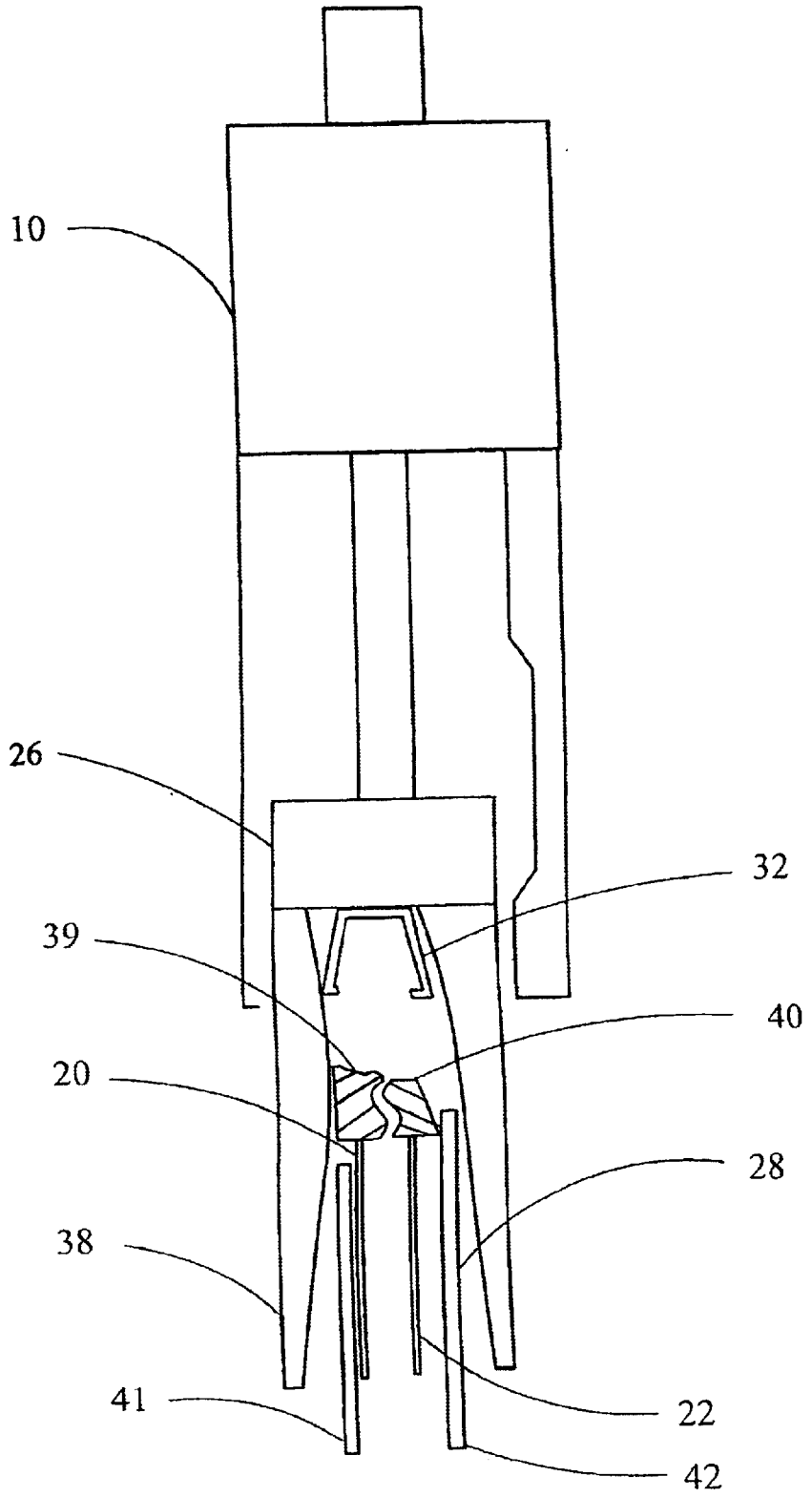
FIG. 3 is a cross-sectional view of the activating fork of the present invention.

As shown in FIG. 3, an activating fork 38 of the activator with pusher 26, when pushed toward the zipper guide 28, vertically offsets interlocking member 39 of the male profile 20 with interlocking member 40 of the female profile 22. In the offsetting or activating action, the profiles 20, 22 are partially disengaged but are not separated. The male profile 20 is supported by a first guide plate 41 of the zipper guide 28 and the female profile 22 is supported by a second guide plate 42 of the zipper guide, with the activation in close proximity to the opening end of the slider 32 to be inserted.

Figure 2:
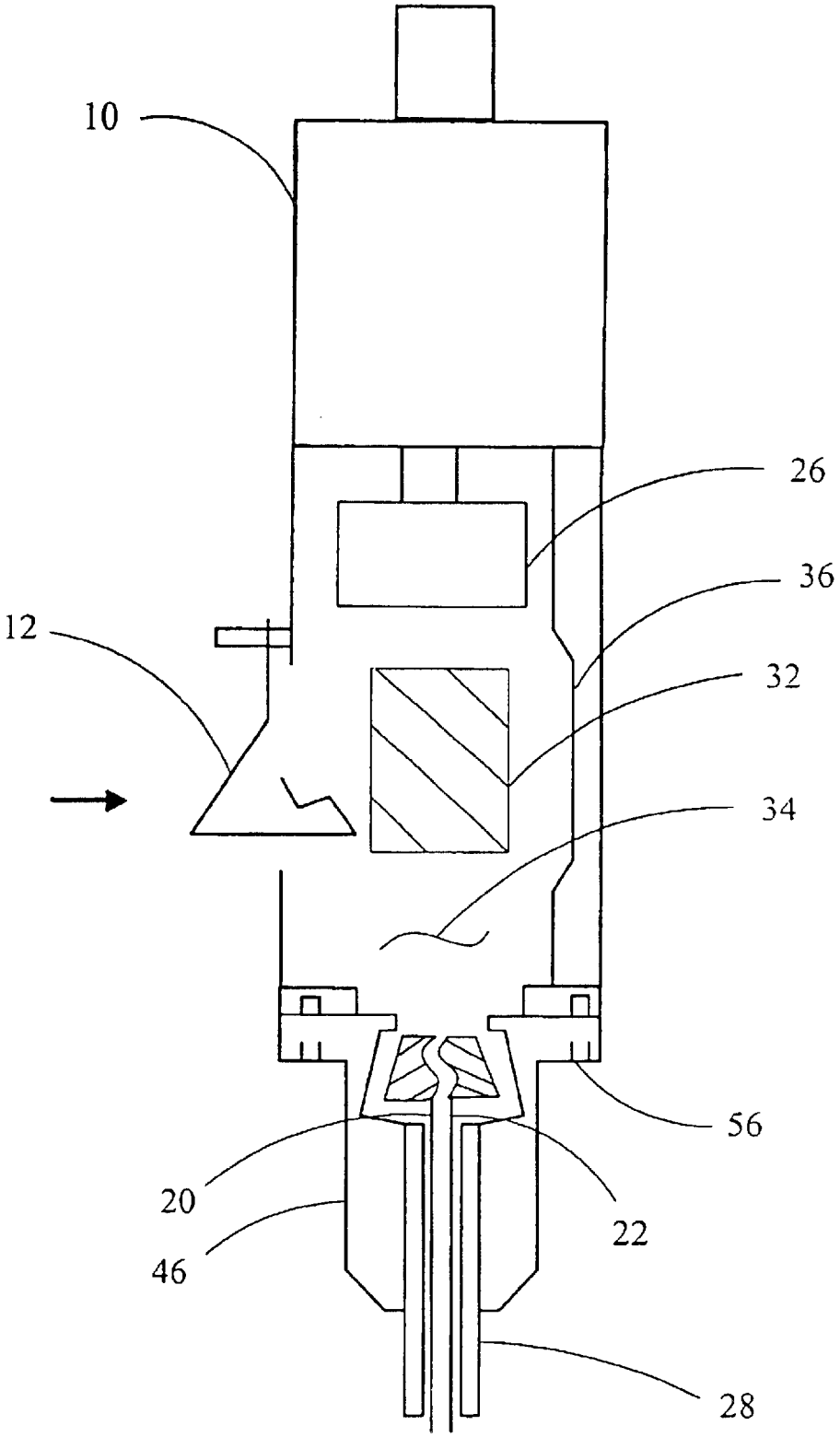
FIG. 2 is a cross-sectional view of the keeper of the present invention attached to the slider insertion apparatus.

Coinciding with the movement of the activating fork 38, the remainder of the activator with pusher 26 inserts the slider 32. The offsetting allows the interlocking members 39, 40 to properly secure within the slider 32. As shown in FIG. 2, an attachment piece 46 attaching the zipper guide 28 to the slider insertion apparatus 10 is notched to secure the remaining portions of the interlocked zipper while the slider 32 is inserted.

After insertion of the slider 32, the activator with pusher 26 of FIG. 1 retracts to allow another slider to be loaded from the loading rack 30 to the slider insertion area 34. The zipper guide 28 then guides a next zipper length into the slider insertion apparatus 10 in direction "A".

Figure 4:
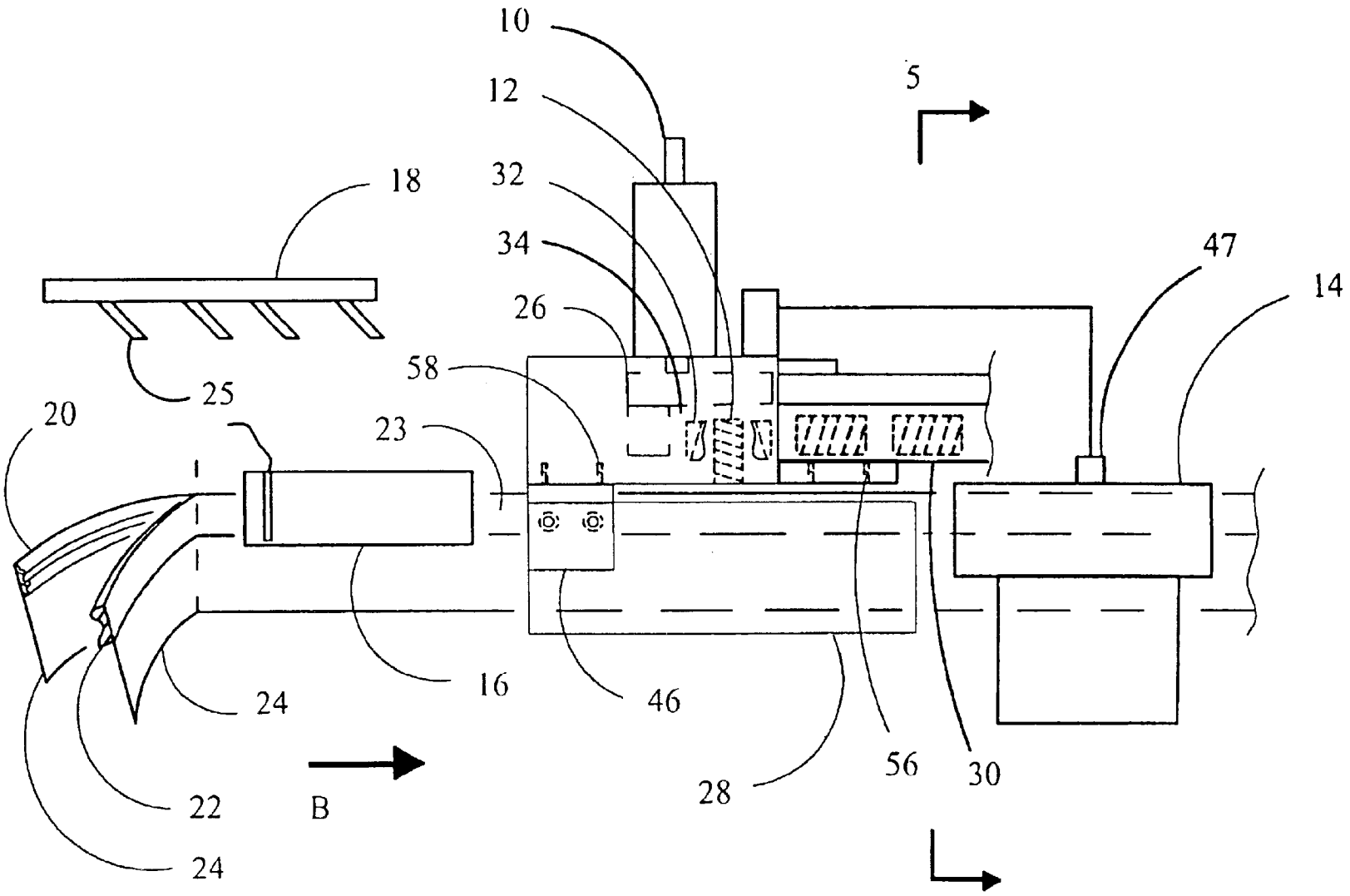
FIG. 4 is a side view depicting the components of the present invention arranged with a slider insertion apparatus with the zipper being indexed in a second direction.

As shown in FIG. 1, the zipper 23 is indexed in direction "A". However, if the operating environment of the slider insertion apparatus 10 requires modification, the insertion apparatus can be adjusted to allow indexing of the zipper 23 in an alternate direction. As shown in FIG. 4, the zipper 23 is indexed in direction "B" toward the insertion area 34. Prior to slider insertion, the heater strip 16 and/or the heated air diffuser 18 heats the zipper 23. Depending on the modification to the slider insertion apparatus, the heater strip 16 and/or the heated air diffuser 18 may be relocated to the other side of the slider insertion apparatus from the positioning shown in FIG. 1 or another set of heating elements may be used.

Figure 5:
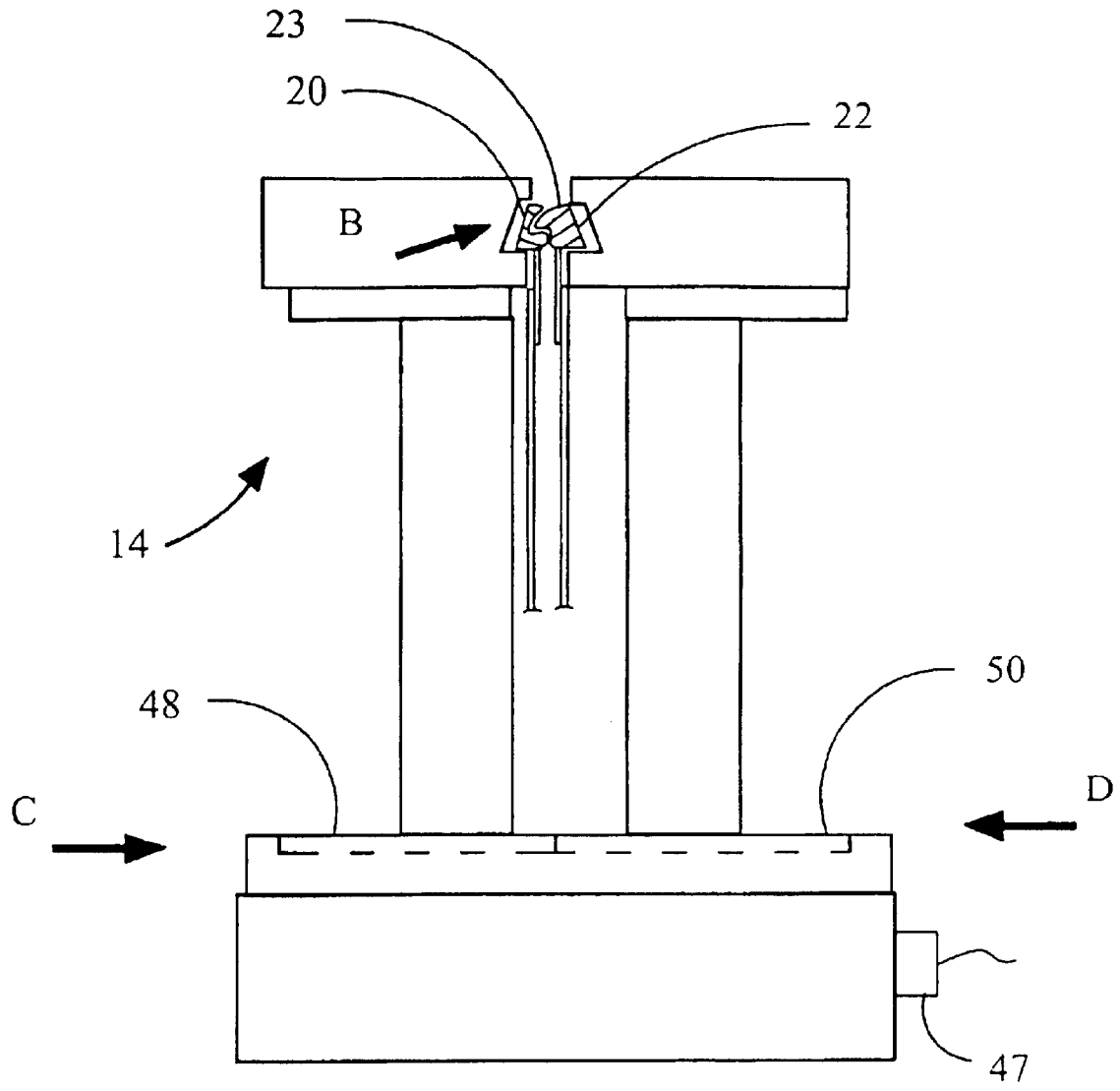
FIG. 5 is a cross-sectional view of the clamp of the present invention in a closed condition.
Figure 6:
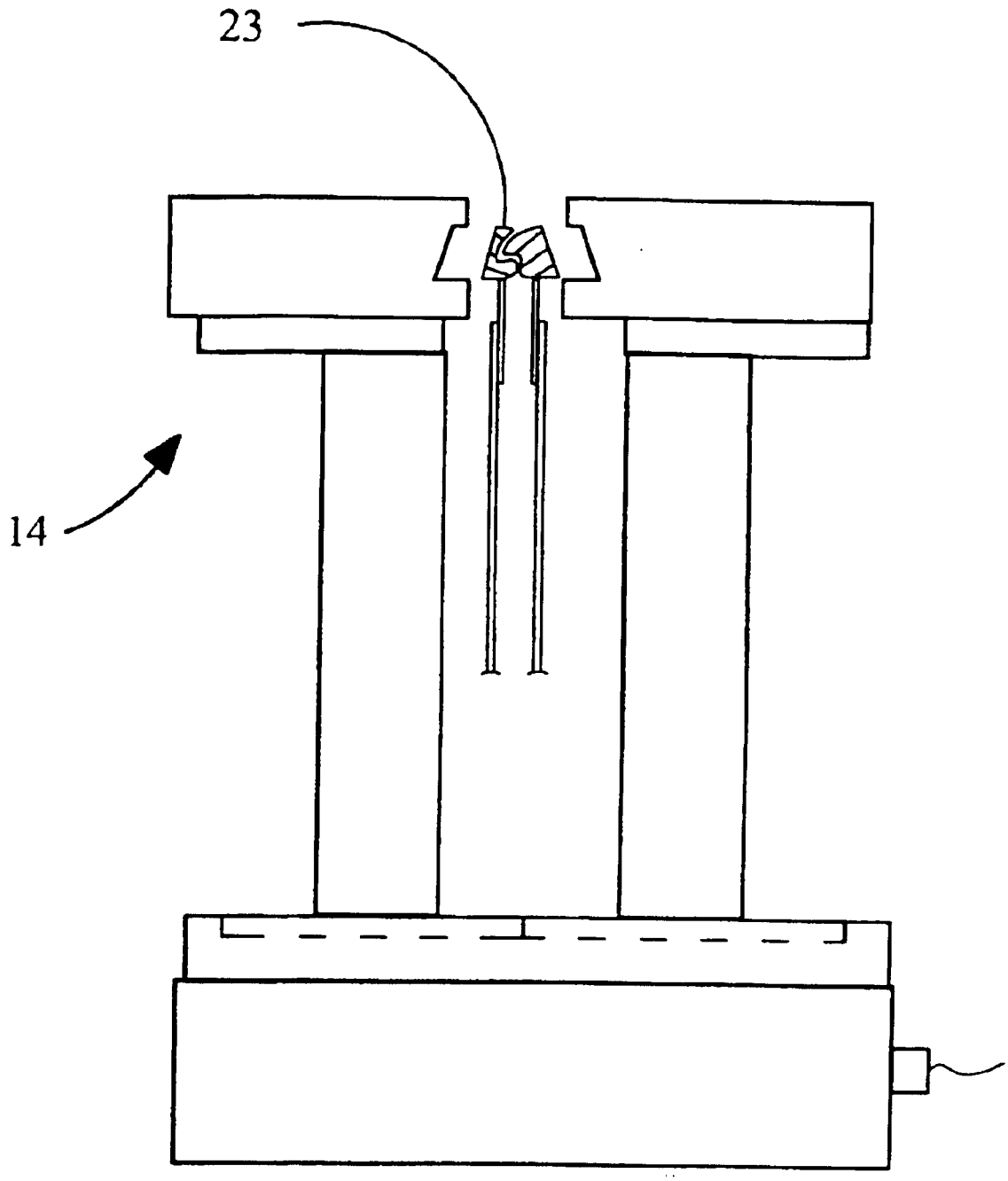
FIG. 6 is a cross-sectional view of the clamp of the present invention in an open condition.

During insertion of the slider 32, the clamp 14 is actuated to a closed condition by a controller 47 in order to clamp the zipper 23. As shown in FIG. 5, the controller actuates the clamp 14 to move in directions "C" and "D" along tracks 48 and 50 in order to clamp the zipper 23. By clamping the zipper 23, the profiles 20, 22 of the zipper are prevented from disengaging as the slider 32 is being inserted on another portion of the zipper. After slider insertion, the clamp 14 is actuated to the open condition shown in FIG. 6 in order to allow further zipper indexing to the slider insertion apparatus 10 in the direction "B". FIG. 6 also represents the open condition of the clamp 14 when the zipper 23 is being indexed in direction "A", shown in FIG. 1.

In order to change the indexing of the zipper 23 from direction "A" in FIG. 1 to direction "B" in FIG. 4, the zipper guide 28 is repositioned. The zipper guide 28 is repositioned by detaching the attachment piece 46 of the zipper guide from mounting area 56 and re-attaching the attachment piece in mounting area 58.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

We claim:

1. An apparatus for inserting a slider onto a length of zipper, said zipper of the type comprising a first profile having a first interlocking member and a second profile having a second interlocking member mated with said first interlocking member, said apparatus comprising:

a heating element for heating a length of said zipper to a predetermined temperature;

a guide for receiving said length of zipper after it has been heated;

an activator with a pusher in a slider insertion area where the activator with the pusher move in a vertical direction perpendicular to said heated length of zipper which is in a horizontal direction, said activator including a portion for engaging a section of said heated length of zipper to urge said first interlocking member to offset relative to said second interlocking member;

said pusher in said slider insertion area guides a slider over said section of zipper and urges said slider over said offset interlocking members; and where the pusher pushes the activator toward the zipper to offset the first and second interlocking members prior to insertion of the slider onto the zipper and coinciding with movement of the activator, a remainder of the activator with the pusher urges the slider over the offset interlocking members.

2. The apparatus in accordance with claim 1 wherein the portion of said activator for engaging said heated length of zipper to urge said first interlocking member to offset relative to said second interlocking member is a forked member.

3. The apparatus in accordance with claim 2 further including a keeper positioned within said slider insertion area of said apparatus wherein said keeper presses the slider to align with said pusher in the slider insertion area.

4. The apparatus in accordance with claim 3 wherein at least one interior wall of the slider insertion area is slotted such that the slider aligns with said keeper when the slider passes from a supply of sliders to said slider insertion area.

5. The apparatus in accordance with claim 4 further including at least two mounting areas for mounting said guide to said apparatus with a first of said mounting areas on an opposite side of the pusher from a second of said mounting areas such that said guide may be placed to receive said zipper from an alternate direction.

6. The apparatus in accordance with claim 5 further including a controller controlling a clamping component, said controller being responsive to the urging of said slider onto said offset interlocking members to keep said first and second interlocking members mated with each other.

7. The apparatus in accordance with claim 1 wherein said heating element is an electrical heater strip in contact with said length of zipper.

8. The apparatus in accordance with claim 1 wherein said heating element comprises a diffuser that directs heated air to said length of zipper.

* * * * *